US010533378B2

(12) United States Patent
Kedare et al.

(10) Patent No.: US 10,533,378 B2
(45) Date of Patent: Jan. 14, 2020

(54) SURFACE ACTUATED DOWNHOLE ADJUSTABLE MUD MOTOR

(71) Applicant: Halliburton Energy Services, Inc., Houston, TX (US)

(72) Inventors: Anand Bhagwat Kedare, Maharashtra (IN); Sandip Satish Sonar, Maharashtra (IN); Ankit Purohit, Madhya Pradesh (IN)

(73) Assignee: HALLIBURTON ENERGY SERVICES, INC., Houson, TX (US)

( * ) Notice: Subject to any disclaimer, the term of this patent is extended or adjusted under 35 U.S.C. 154(b) by 168 days.

(21) Appl. No.: 15/037,771

(22) PCT Filed: Dec. 23, 2013

(86) PCT No.: PCT/US2013/077436
§ 371 (c)(1),
(2) Date: May 19, 2016

(87) PCT Pub. No.: WO2015/099652
PCT Pub. Date: Jul. 2, 2015

(65) Prior Publication Data

US 2016/0290049 A1 Oct. 6, 2016

(51) Int. Cl.
*E21B 7/06* (2006.01)

(52) U.S. Cl.
CPC ..... *E21B 7/067* (2013.01)

(58) Field of Classification Search
CPC ..... E21B 7/06; E21B 7/067
See application file for complete search history.

(56) References Cited

U.S. PATENT DOCUMENTS 4,067,404 A 1/1978 Crase
4,884,643 A * 12/1989 Wawrzynowski ..... E21B 7/067 175/74

(Continued)

FOREIGN PATENT DOCUMENTS

GB 2271795 A 4/1994
GB 2363811 A 1/2002
GB 2373272 A 9/2002

OTHER PUBLICATIONS

International Search Report and The Written Opinion of the International Search Authority, or the Declaration, dated Apr. 16, 2014, PCT/US2013/077436, 12 pages, ISA/US.

*Primary Examiner* — Robert E Fuller
*Assistant Examiner* — Lamia Quaim

(57) ABSTRACT

A downhole tool having a mechanically adjustable bend angle from the surface and method for actuation of the tool. The tool includes a knuckled joint between upper and lower housing assemblies and tapered setting ring upon which the lower housing assembly bears. As the setting ring is rotated with respect to the upper housing assembly, the lower assembly is tilted. A spline sub for connection to a drill string is included, which, upon a certain weigh on bit, axially moves within the tool housing to engage the tapered setting ring and force shoes radially outward to engage the formation and hold the tool stationary. The drill string is then rotated to rotate the setting ring, and thereby alter the tool bend angle. Toggles hold the setting ring fixed to the upper housing to maintain a given bend angle during drilling operations.

23 Claims, 10 Drawing Sheets

(56) References Cited

U.S. PATENT DOCUMENTS

| | | | | |
|---|---|---|---|---|
| 5,495,900 | A * | 3/1996 | Falgout, Sr. | E21B 4/02 175/101 |
| 5,899,281 | A | 5/1999 | Gynz-Rekowski | |
| 6,394,193 | B1 | 5/2002 | Askew | |
| 6,470,974 | B1 | 10/2002 | Moore et al. | |
| 6,516,901 | B1 * | 2/2003 | Falgout, Sr. | E21B 7/067 175/256 |
| 6,554,083 | B1 * | 4/2003 | Kerstetter | E21B 7/067 175/107 |
| 6,659,201 | B2 | 12/2003 | Head et al. | |
| 6,843,332 | B2 * | 1/2005 | Eppink | E21B 4/006 175/320 |
| 7,882,904 | B2 | 2/2011 | Von Gynz-Rekowski et al. | |
| 2002/0007969 | A1 | 1/2002 | Head et al. | |

* cited by examiner

SURFACE ACTUATED DOWNHOLE ADJUSTABLE MUD MOTOR

The present application is a U.S. National Stage patent application of International Patent Application No. PCT/US2013/077436, filed on Dec. 23, 2013, the benefit of which is claimed and the disclosure of which is incorporated herein by reference in its entirety.

TECHNICAL FIELD

The present disclosure relates generally to oilfield equipment, and in particular to downhole tools.

BACKGROUND

A steerable drilling system is used to control the direction a borehole is drilled. Steerable drilling systems include both bent housing systems and rotary steerable systems. Bent housing systems, in particular, conventionally utilize a bent housing in combination with a downhole motor (i.e. a "mud motor"). The bent housing may include a fixed bend or an adjustable bend. Adjusting an angle of the bend on a bent housing conventionally involves tripping out of the well. The mud motor may be selectively powered by drilling fluid pumped from the surface to rotate the drill bit.

To drill a straight section of the borehole with a bent housing system, the drill string is rotated from the surface, without operating the mud motor, so that the bent housing rotates along with the bit about an axis of bit rotation. To change the direction the borehole is drilled, rotation of the drill string is ceased, with the bent motor at a selected rotational position. With the bent motor at the selected rotational position, the bit is then rotated using only the mud motor, to form the deviated section at an angle to the previously-drilled straight section, as guided by the bent housing. The deviated section is drilled until a desired direction is achieved. Once the desired direction is achieved, rotation of the bit using the mud motor is ceased and rotation of the drill string from the surface is resumed to drill another straight section.

BRIEF DESCRIPTION OF THE DRAWINGS

Embodiments are described in detail hereinafter with reference to the accompanying figures, in which.

DETAILED DESCRIPTION

Structure of Tool

Figure 1:
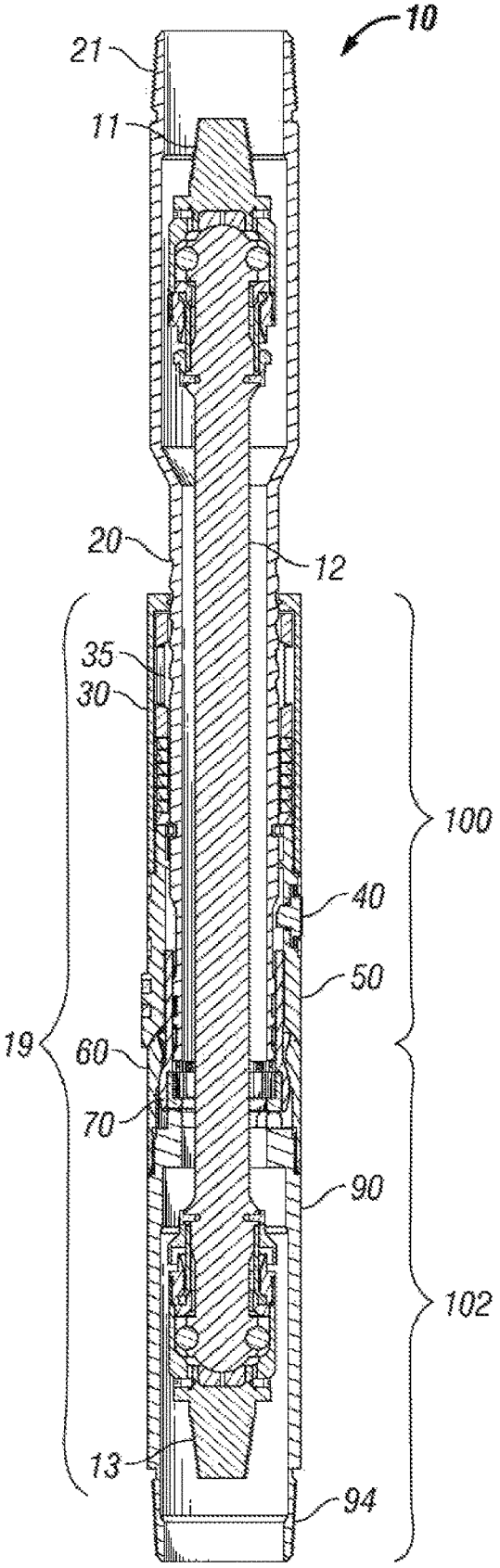
FIG. 1 is an axial cross section of a surface-actuated downhole-adjustable mud motor bent sub according to a preferred embodiment, showing an adjustable bent section, presently set with a zero-degree bend, for inclusion between an upper power section and a lower bearing section of a mud motor.
Figure 14:
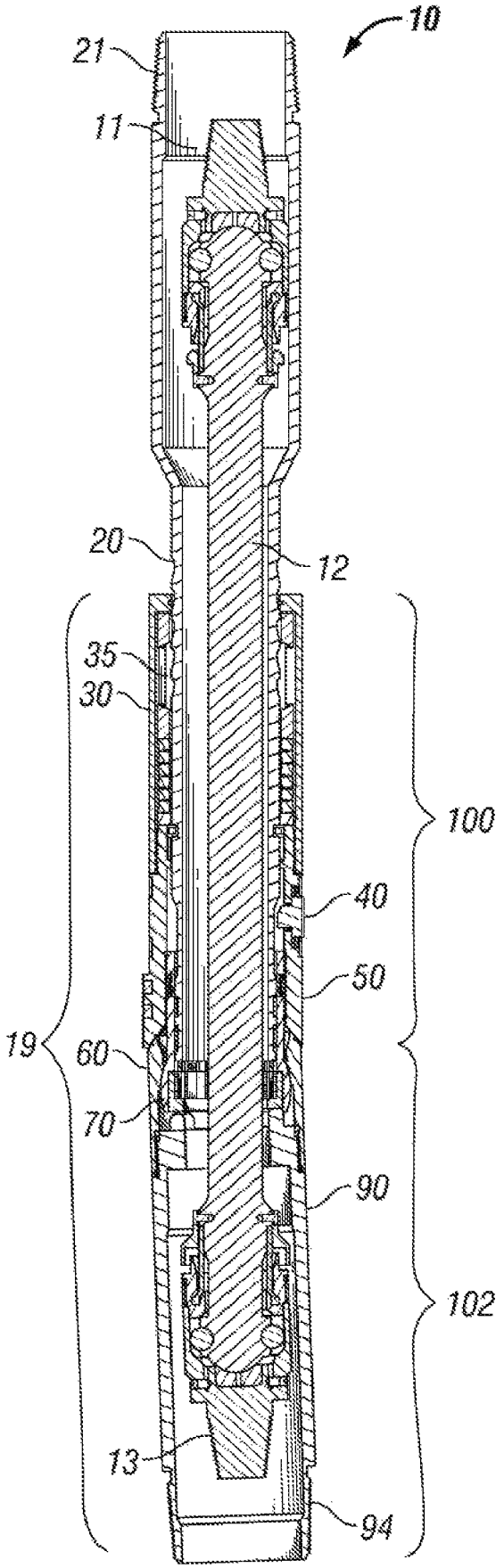
FIG. 14 is an axial cross section of the surface-actuated downhole-adjustable mud motor bent sub of FIG. 1, showing the tool in a maximum bend configuration.

FIG. 1 illustrates the bent sub tool 10 in a straight configuration according to a preferred embodiment, and FIG. 14 illustrates the same bent sub tool. 10 in a maximum bent configuration. An upper housing assembly 100 includes a lock housing assembly 30, a knuckle extension 50, and a knuckle housing 70. A lower housing assembly 102 includes a lower housing 90 and a knuckle lock ring 60. The complete housing assembly 19 includes the upper housing assembly 100 and the lower housing assembly 102.

Figure 16:
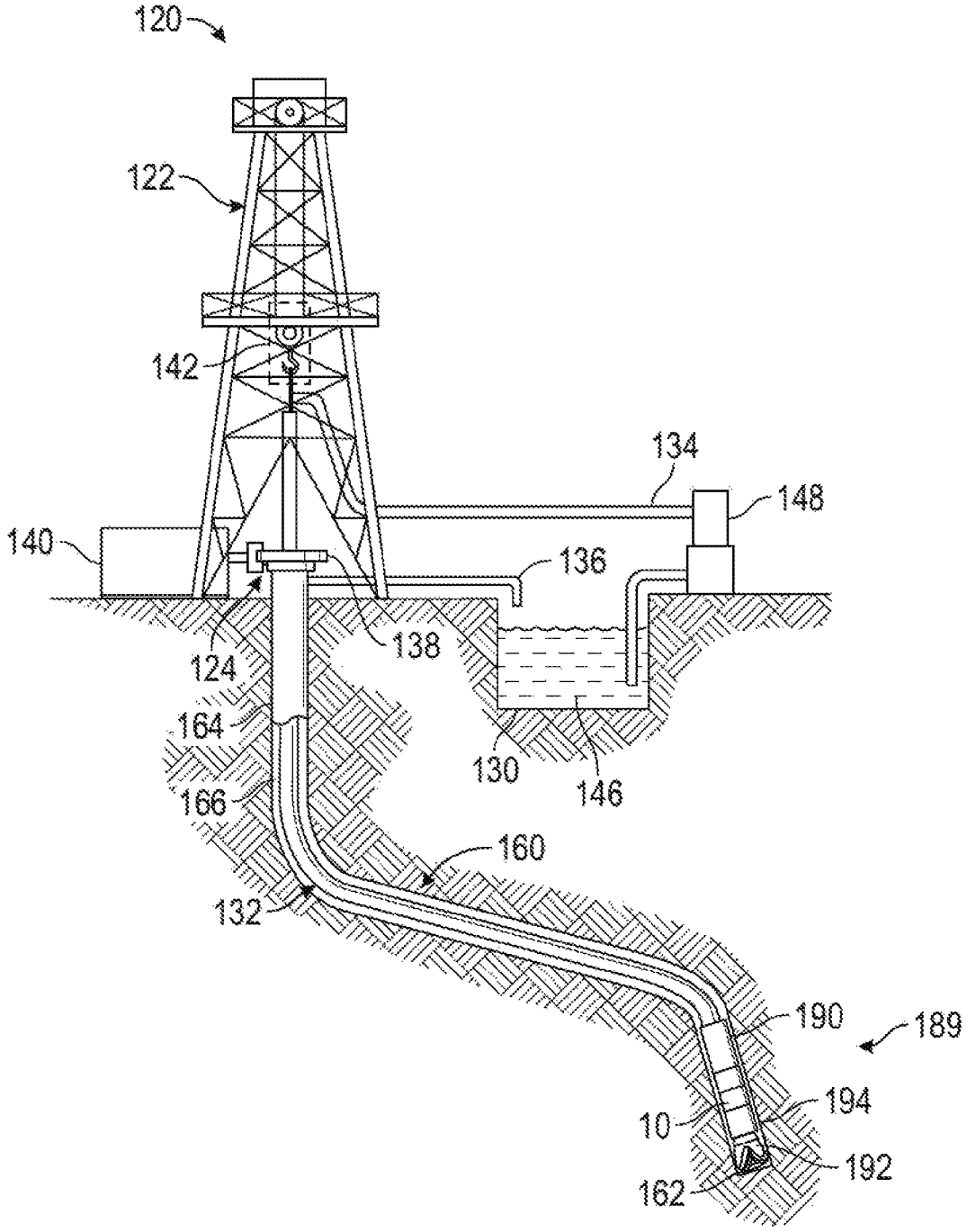
FIG. 16 is an elevation view in partial cross section of a drilling system according to an embodiment that employs the surface-actuated downhole-adjustable mud motor bent sub of FIGS. 1-15.

Bent sub tool 10 includes upper and lower pin connectors 21, 94 and a constant velocity shaft assembly 12 with upper and lower pin connectors 11, 13. Bent sub tool 10 includes a spline sub 20, which terminates at its upper end with pin connection 21. Pin connection 21 connects with a box connector at the bottom end of an upper housing, or stator, of a mud motor power section 190 (FIG. 16) that transmits power to the drill bit 192 (FIG. 16). The mud motor power section is supported from a drill string 132 (FIG. 16) that extends to the surface. The lower pin connector 94 connects to a bearing section 194 (FIG. 16) of a conventional mud motor. The rotor from the mud motor power section (not expressly shown) connects within the spline sub 20 to the constant velocity shaft assembly 12 at upper connector 11. The mud motor power section 190 (FIG. 16) is operable to rotate drill bit 192 (FIG. 16) via constant velocity shaft assembly 12. In addition to accommodating power transmission over the bend angle, constant velocity shaft assembly 12 allows for the spiraling nutation of the power section of the mud motor.

As is described in greater detail below, the lower end of spline sub 20 is received within and has limited axial and rotational movement with respect to a complete housing assembly 19, which includes, among other components, a lock housing 30, a knuckle extension 50, a knuckle lock ring 60, and a knuckle housing 70, and a lower housing 90.

Figure 2:
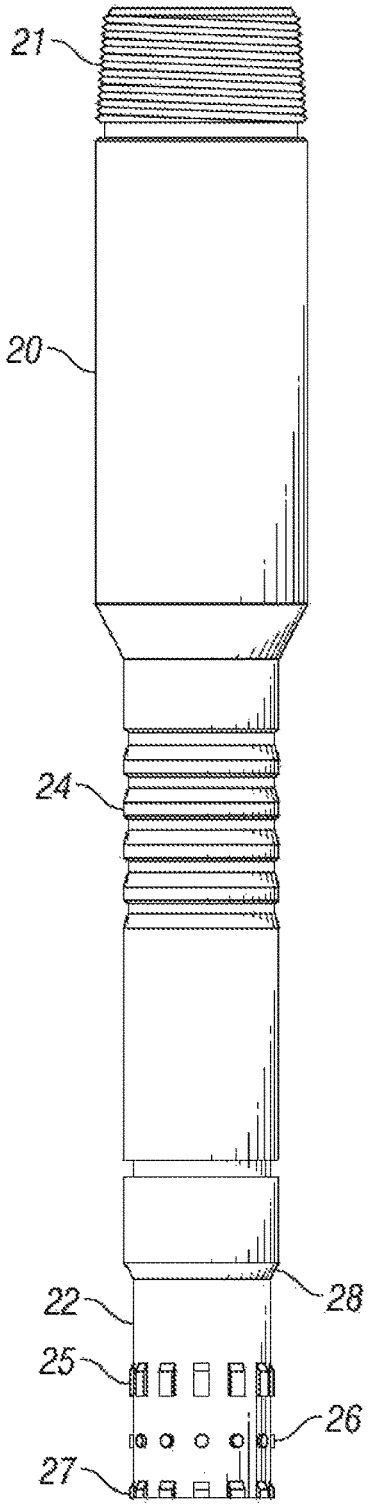
FIG. 2 is an enlarged elevation of a spline shaft of the bent sub of FIG. 1, showing features used for the transmission of weight on bit, rotary drilling torque, and selective adjustment of bend angle.
Figure 3:
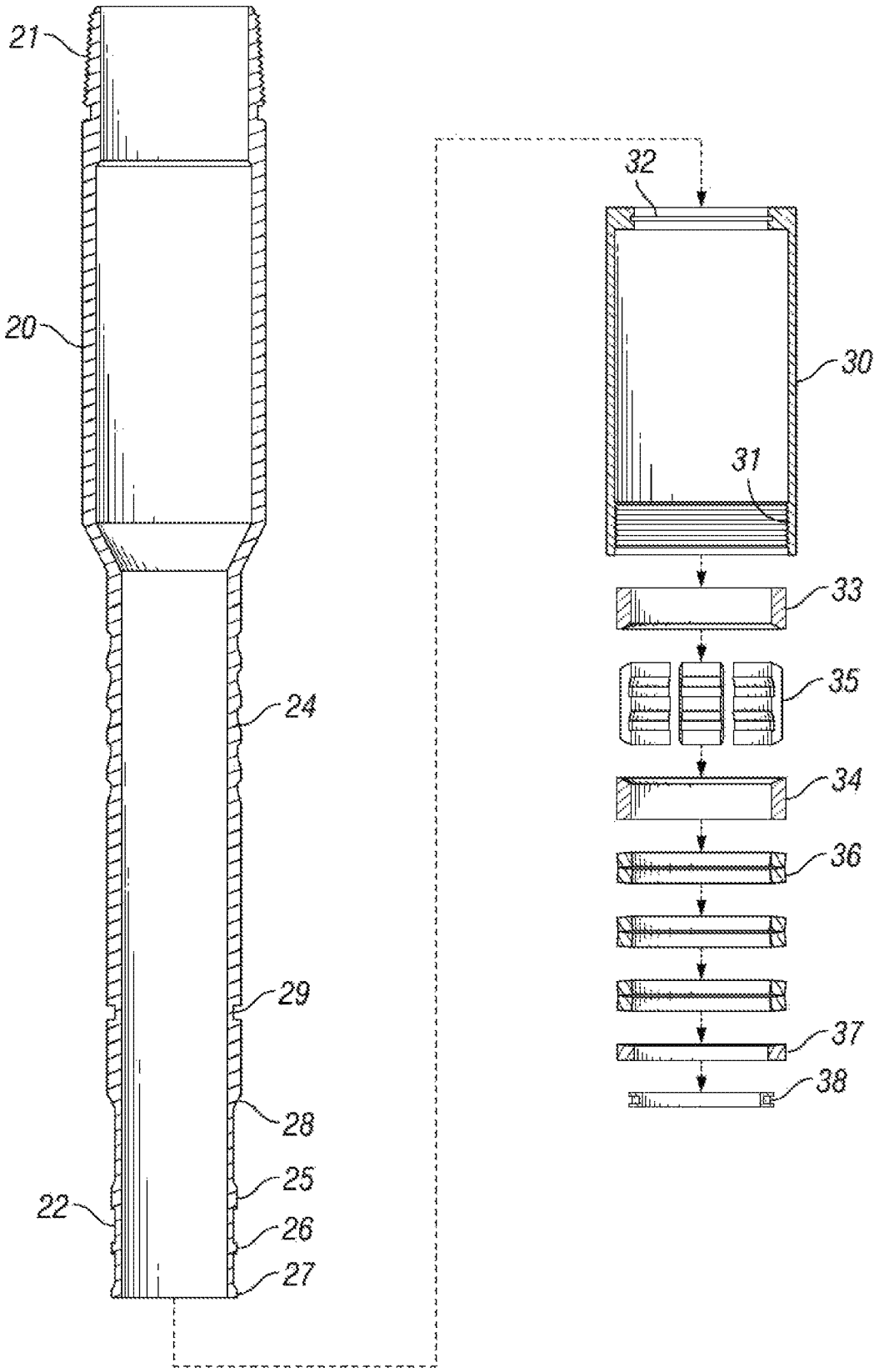
FIG. 3 is an enlarged, exploded diagram in axial cross section of the spline shaft of FIG. 2 and a lock housing assembly, showing, a latch system that transfers weight on bit and prevents adjustment of bend angle until a maximum operational weight on bit set point is exceeded.

Referring to FIGS. 2 and 3, spline sub 20 has an upper pin end 21 for connecting to the power section stator (not illustrated) and a lower spline end 22. Lower Spline end 22 has six notable features: Latch grooves 24, upper spline 25, bosses 26, lower spline 27, tapered shoulder 28, and stopper ring groove 29.

Latches 35 within lock housing 30 engage latch grooves 24 to substantially prevent axial movement of splined sub 20 with respect to lock housing 30 until a predetermined maximum weight on bit set point is exceeded, as is described in further detail with respect to FIGS. 9 and 15 below.

Upper spline 25 is used when torque is applied to the drill string during vertical drilling operation. Upper spline 25 engages with the collapsible splines 71 provided in the inside portion of knuckle housing 70 (best seen in FIGS. 4 and 8) to allow complete housing assembly 19 to rotate when torque is applied. Collapsible splines 71 remain in a normal radial inward position for torque transfer, and only collapse into the slots 77 formed in knuckle housing 70 (FIG. 8) as necessary to allow spline shaft 20 to be withdrawn upwards from a lower, bend setting position to the upper, normal torque transfer position, as described in greater detail below.

Bosses 26 are formed on the external surface of spline sub 20 and engage a circumferential array of inwardly protruding arches 78 formed on the interior wall of knuckle housing 70 to allow easy disengagement of spline sub 20 after bend setting adjustment, as described in greater detail below.

Figure 10A:
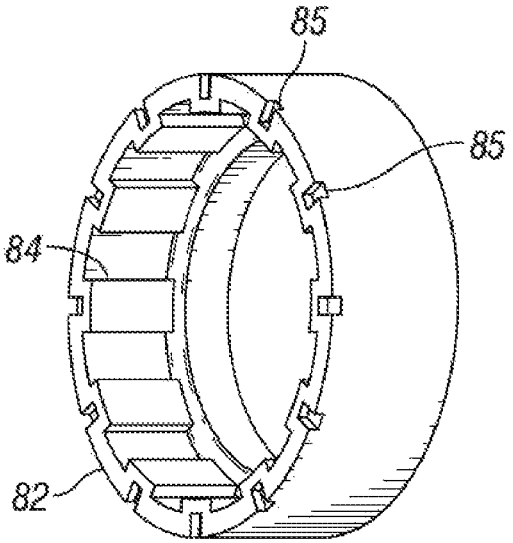
FIG. 10A is a perspective view of the upper end of the setting ring of FIG. 9, showing the internal spline for adjustment of bend angle and slots formed in the outer circumference at an upper face for maintaining a set bend angle.
Figure 10B:
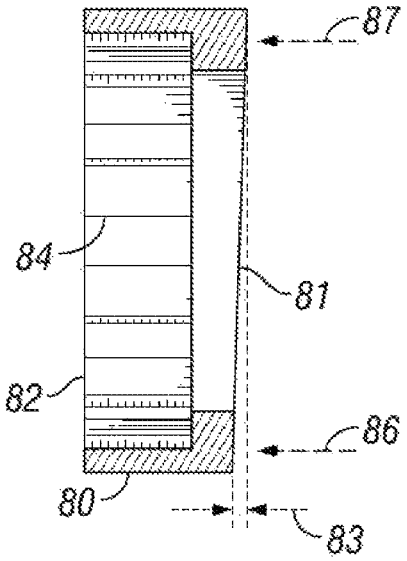
FIG. 10B is an enlarged axial cross section of the setting ring of FIG. 10A, showing a lower face that is tapered with respect to the upper face.
Figure 10C:
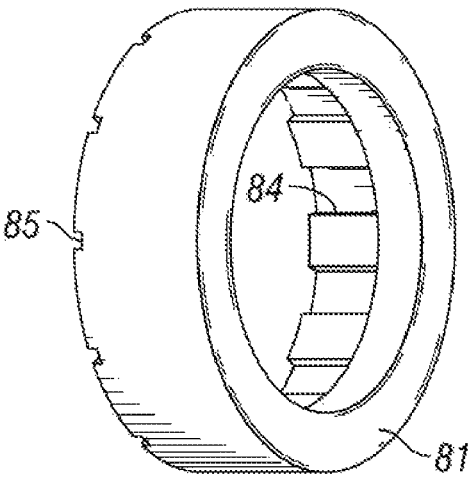
FIG. 10C is a perspective view of the lower end of the setting ring of FIG. 10A, showing the internal spline for adjustment of bend angle and slots formed in the outer circumference of the upper face for maintaining a set bend angle.

Lower spline 27 engages with internal spline 84 provided in the inside diameter of a tapered setting ring 80 (FIGS. 10A-10C) only during adjustment of bend angle or inclination. Using lower spline 27, setting, ring 80 can be rotated about the drill string axis with respect to lock housing 30, knuckle extension 50, knuckle lock ring 60, and knuckle housing 70, as described in greater detail below.

Tapered shoulder 28 at the lower end 22 of spline sub 20 is used to engage tapered surfaces 42 of shoes 40 (FIGS. 4, 6, and 9, for example) and convert downward axial force on spline sub 20 to radial outward force of shoes 40 out during adjustment of bend angle or inclination, as is described in greater detail below.

Finally, stopper ring groove 29 receives stopper ring 38.

Figure 4:
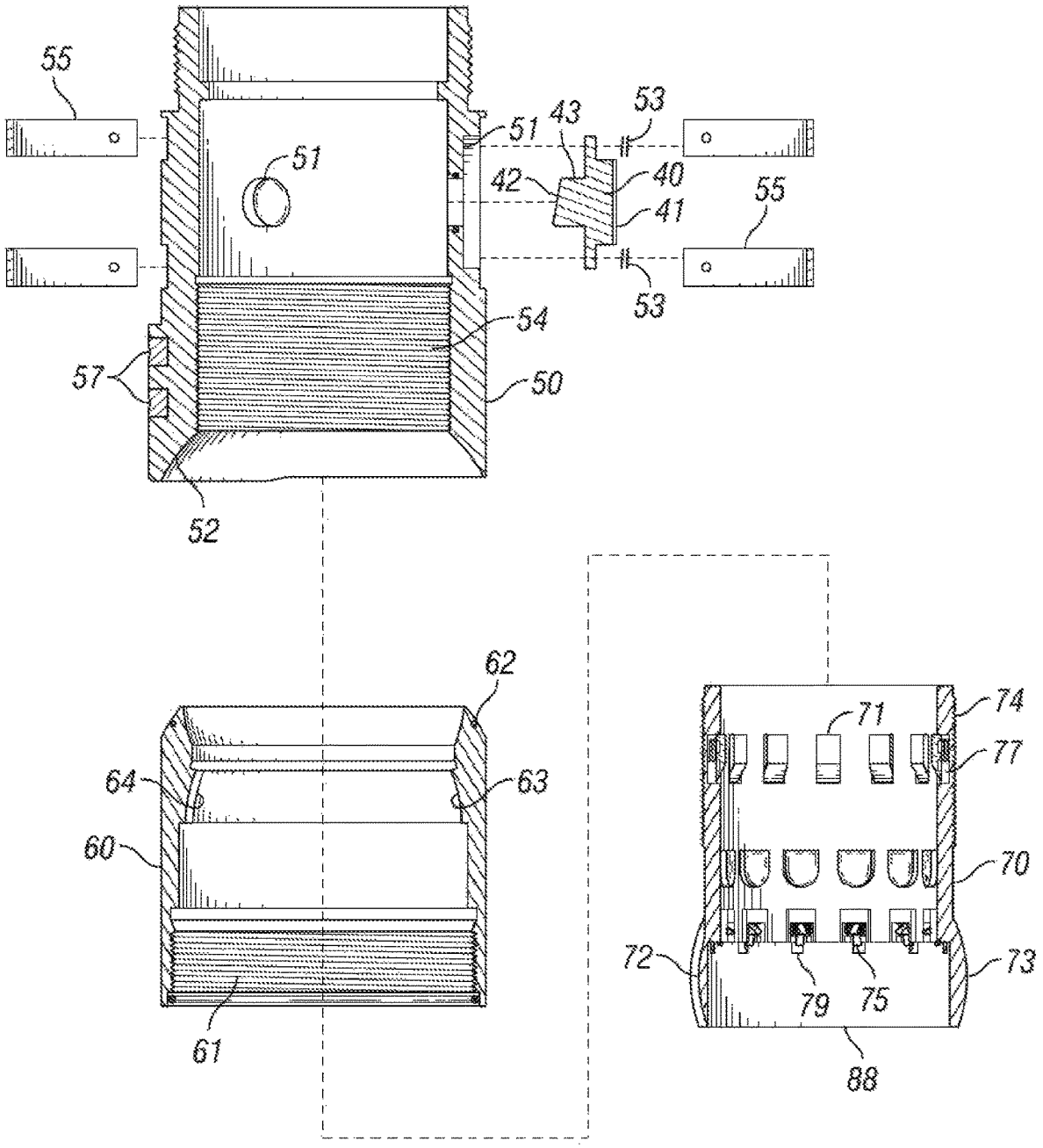
FIG. 4 is an enlarged exploded diagram in axial cross section of a knuckle assembly of the bent sub of FIG. 1, showing a knuckle housing, a knuckle lock ring, and a knuckle extension with radially extending shoes for engaging the sides of the bore hole while adjusting bend angle.

Referring to FIG. 3, lock housing 30 is a cylindrical housing, open at both ends, having threads 31 on its lower inner diameter for connection to the upper end of knuckle extension 50 (FIG. 4). Lock housing 30 houses retainer rings 33, 34, latches 35, belleville springs 36, spacer ring 37, and stopper ring 38. An O-ring groove 32 is formed on its upper inner diameter for sealing against spline sub 20.

Referring to FIG. 4, knuckle extension 50 has three noteworthy features: A first feature is the provision of T-shaped cavities or pockets 51, into which shoes 40 are received, in a preferred embodiment, three spaced pockets 51 are provided (only two are visible in FIG. 4) at equally spaced 120 degree intervals about the circumference of knuckle extension 50. However, a greater or lesser number of pockets 51 may be provided as appropriate. A second feature is the provision of an interior spherical surface 52 at the bottom end of knuckle extension 50, whose center point acts as the pivot point for bend setting. Spherical surface 52 mates with the exterior spherical surface feature 62 at the top end of the knuckle lock ring 60. A third feature is provision for low side button carbide inserts 57 on the outside, which sustain the side load forces when the bent sub tool 10 is operating in a bent position. Knuckle extension 50 has internal threads 54 in its lower end that engage with the external threads 74 of knuckle housing 70.

Figure 5:
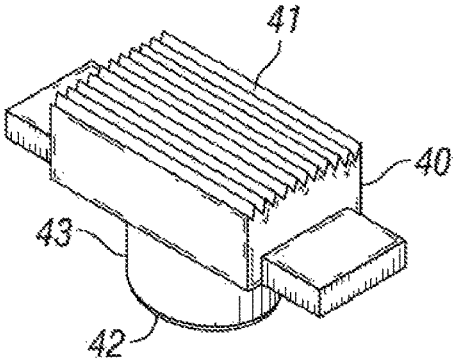
FIG. 5 is an enlarged perspective view of a shoe of FIG. 4, showing the serrated outer surface for engaging the sides of the bore hole while adjusting bend angle.
Figure 7:
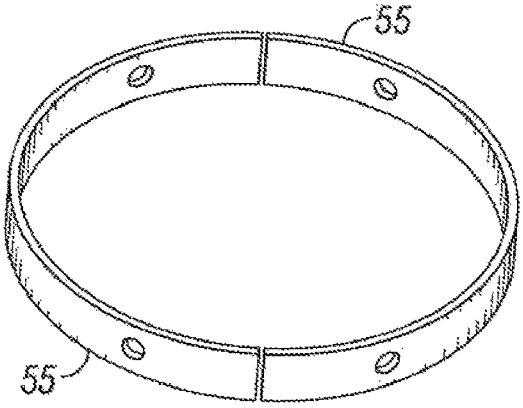
Figure 6:
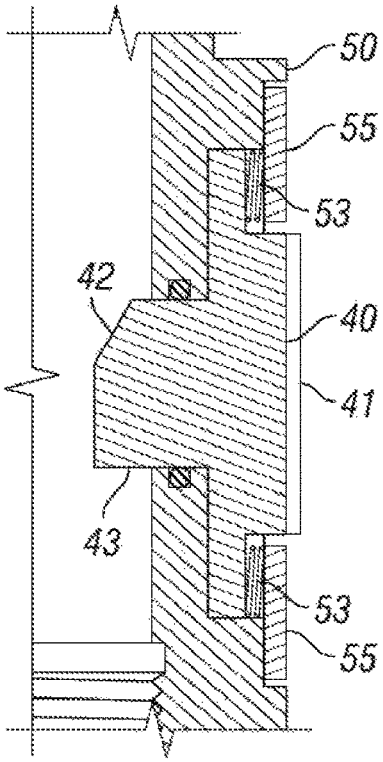
FIG. 6 is a detailed axial cross section of a portion of the knuckle extension of FIG. 4 and the shoe of FIG. 5, showing springs for urging the shoe radially inward and sectioned rings for securing the shoe within a pocket formed through the wall of the knuckle extension.

Referring to FIGS. 4-6, shoe 40 is a component that has a gripping feature on its outer face 41 and an inclined face 42 on an inner cylindrical stem 43. In certain embodiments, the gripping feature may be serrated or textured. A number of shoes 40 sit in pockets 51 provided on the outer surface of the knuckle extension 50. Shoe lock ring 55 is a simple ring split into two halves 55', 55" that is used to hold shoes 40 within pockets 51 in knuckle extension 50. Springs 53 are provided between shoes 40 and shoe lock rings 55 to urge the shoes 40 inside towards the tool axis.

During bend setting operations, the tapered shoulder 28 at the lower end 22 of spline sub 20 (FIGS. 1 and 3) pushes against tapered surfaces 42 to force shoes 40 radially outward to grip the formation for constraining rotation of the knuckle extension 50 and to provide the directional reference.

Figure 9:
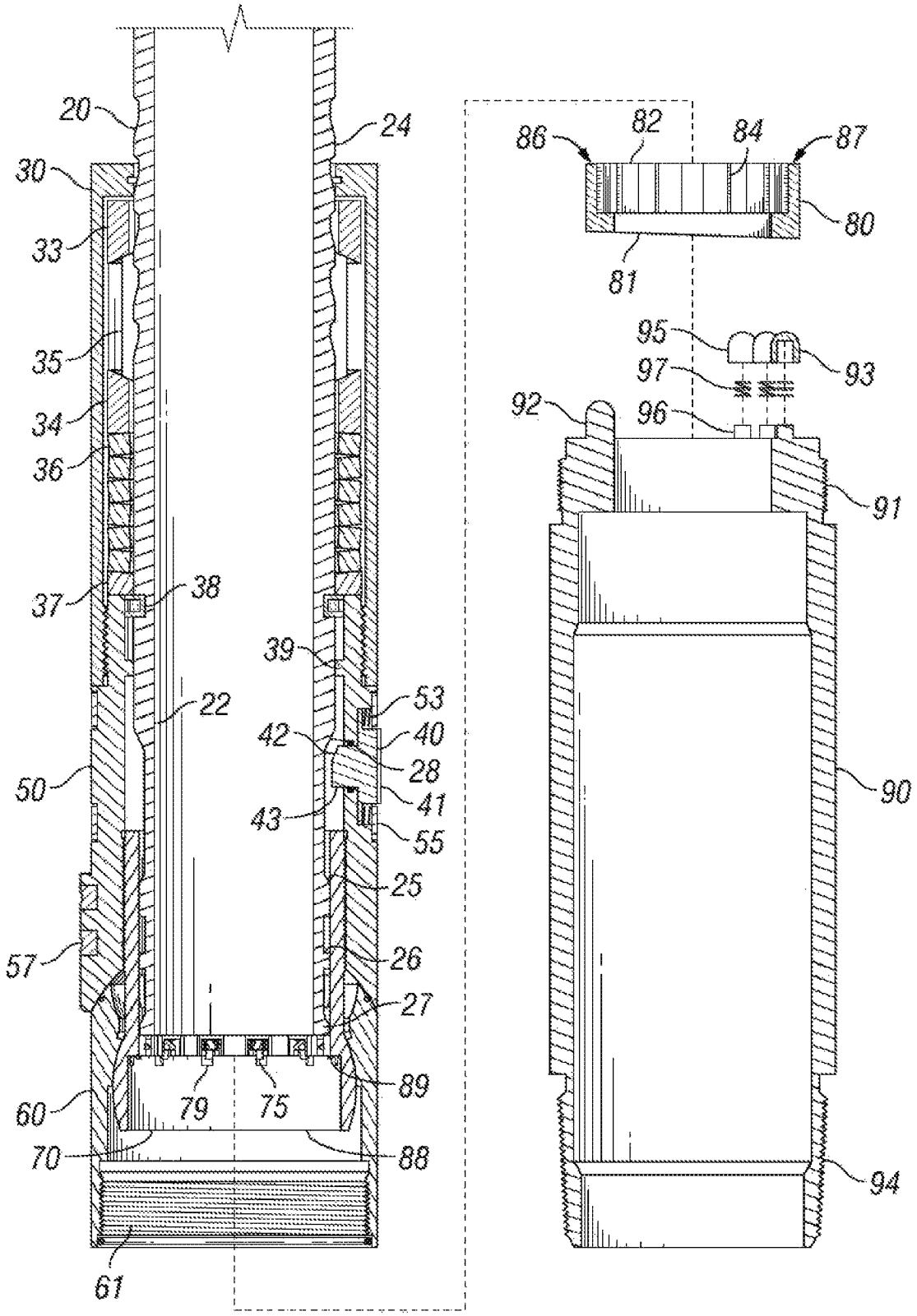
FIG. 9 is an enlarged exploded diagram in axial cross section, showing the assembly of a setting ring and lower housing with the assembled spline shaft of FIG. 2, lock housing assembly of FIG. 3, and the knuckle assembly of FIG. 4, with the spline shaft located in an upper normal torque transfer position with respect to the lock housing and knuckle assembly.

Referring to FIGS. 1, 4 and 9, knuckle lock ring 60 has internal threads 61 which mate with external threads 91 of lower housing 90. Knuckle lock ring 60 also features two spherical surfaces. External spherical surface 62 at the upper end of knuckle lock ring 60 mates with internal spherical surface 52 of knuckle extension 50. Internal spherical surfaces 63 mates with the external spherical surface 73 on knuckle housing 70. Thus, lower housing assembly 102 is pivotally connected to the upper housing assembly 100 by being sandwiched between the internal spherical surface 52 and the external spherical surface 73 of the upper housing assembly.

Knuckle lock ring 60 also has an inwardly projecting key 64 having a spherical profile that fits into a spherically shaped keyway slot 72 formed in knuckle housing 70. Key 64 and slot 72 are provided to restrict relative rotational motion between knuckle lock ring 60 and knuckle housing 70 about the tool longitudinal axis. Projecting key 64 and keyway slot 72 permit movement only within a single geometric plane between knuckle lock ring 60 and knuckle housing 70. Although one projecting key 64 and keyway slot 72 are illustrated for simplicity, two such features may be provided 180 degrees apart.

Figure 8:
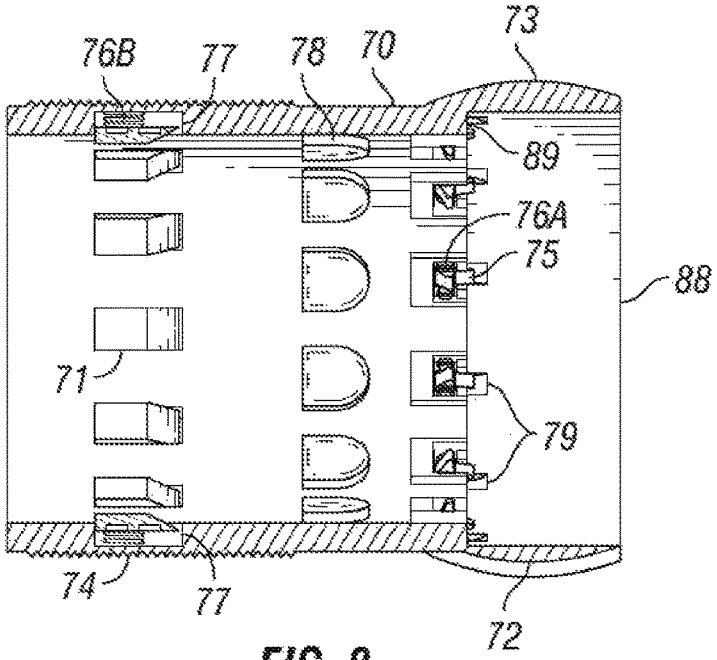
FIG. 8 is an enlarged axial cross section of the knuckle housing of FIG. 4, showing a radially collapsible spline for transmission of drill string torque, a mouth into which a setting ring is received, a circumferential array of toggles for rotatively fixing the setting ring.

Referring now to FIGS. 4, 8, and 9, knuckle housing 70 assists in tilting, lower housing 90 with respect to knuckle extension 50. It is the primary component that restricts independent rotation of lower housing 90 about the tool axis and allows only tilting. Knuckle housing 70 defines a mouth 88 into which a setting ring 80 is received and a shoulder 89 against which the upper face 82 of setting ring 80 seats.

Knuckle housing 70 includes external threads 74 that are threaded to internal threads 54 of knuckle extension 50. One or two spherically-profited slots 72 on the exterior surface of knuckle housing 70 are provided to engage knuckle lock ring keys 64 to prevent relative rotation therebetween, as previously described.

Knuckle housing 70 includes a circumferential array of small slots 79 formed in its interior wall, into which V-shaped two-fingered toggles 75 are received and pivotally mounted using pins. Torsion springs 76A are mounted about the toggle pivot pins and operate to urge toggles 75 radially inward. Toggles 75 are used to selectively hold setting ring 80 rotationally stationary with respect to knuckle housing 70 and thereby maintain a particular bend angle for drilling a curved section of a well, as described in greater detail below with respect to FIGS. 12 and 13.

Knuckle housing 70 also includes a circumferential array of larger slots 77 formed in its interior wall into which tapered radially-adjustable splines 71 are slideably received. Adjustable internal splines 71 are independently radially movable with respect to knuckle housing 70 and are urged radially inward by springs 76B. Adjustable internal splines 71 function to transmit torque from upper splines 25 of spline sub 20 to the knuckle housing 70 during drilling operations, but are arranged to collapse as necessary upon raising spline shaft 20 from a lower bend setting position to an upper normal torque transfer position.

Finally, knuckle housing 70 has an circumferential array of inwardly protruding arches 78 formed in its interior wall that engage with bosses 26 on lower spline end 22 of spline sub 20 (see FIG. 3) to allow easy exit of spline sub 20 from setting ring 80 after bend setting adjustment, as described in greater detail below.

Figure 11:
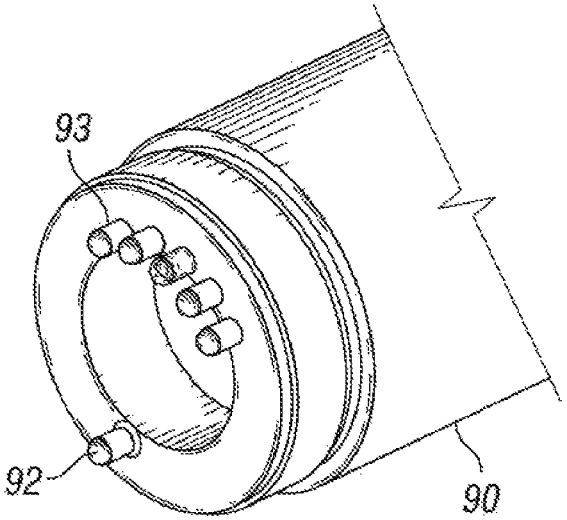
FIG. 11 is a perspective view of the upper end of the lower housing of FIG. 9, showing a fixed boss and a number of spring-loaded telescopic tension buttons for abutment with the lower face of the setting ring of FIG. 10C.

Referring to FIGS. 9-11, lower housing 90 has one or more fixed bosses 92 axially extending from one lateral side of its upper end, which abuts the lower face 81 of setting ring 80. On the opposite lateral side of its upper end, lower housing 90 has one or more spring-loaded tension buttons 93, which assist in holding the bent sub for building or dropping the inclination. Each tension button 93 includes a hollow cap 95 that fits over a post 96, with a spring 97 positioned therebetween that urges cap 95 axially upwards.

Setting ring 80 has an upper face 82, which is received into mouth 88 and seated against shoulder 89 of knuckle housing 70. Setting ring 80 has a lower face 81, or bearing surface, upon which axially-oriented fixed boss 92 and telescopically adjustable tension buttons 93 of lower housing 90 bear. Preferably, there is a three degree taper provided on the lower face 81 as compared to the upper face 82, as indicated, by arrows 83 in FIG. 10B. In one embodiment, the taper is approximately three degrees. In another embodiment, the taper is no more than eight degrees. Accordingly, about its circumference, setting ring 80 defines a point 86 of minimum axial length and, 180 degrees about its axial centerline, a point 87 of maximum axial length.

The rotational position of setting ring 80 with respect to knuckle housing 70 determines the bend of tool 10. The axial length of fixed boss 92 is set so that when setting ring 80 is oriented such that the point 86 of minimum axial length is aligned with fixed boss 92, tool 10 has a zero degree bend, as shown in FIG. 1. When setting ring is rotated 180 degrees so that the point 87 of maximum axial length aligns with fixed boss 92, tool 10 has a maximum bend wherein the taper determines the maximum bend angle. For example, a setting ring 80 characterized by a three degree taper has a maximum bend angle of three degrees.

Slots 85 on the outer circumference at the upper face 82 are for receiving toggles 75 to hold setting ring 80 in a particular bend position. Internal splines 84 are used to rotate setting ring 80 using lower spline 27 of the spline sub 20. A needle hearing assembly (not illustrated) can be provided between the setting ring 80 and knuckle housing 70 to promote ease of relative rotation. Alternatively, the surfaces can also be made smooth and function as a plain hearing.

Referring now to FIGS. 9 and 11, lower housing 90 has exterior threads 91 at its upper end for mating to internal threads 61 at the bottom end of knuckle lock ring 60. The lower end of lower housing 90 has external threads 94 for connection to a hearing section of a conventional mud motor. As mud motor bearing sections are known to routineers in the art, such is not illustrated or described further herein. Lower housing 90 accommodates constant velocity shaft assembly 12 and its lower connector 13 (FIG. 1) with enough room to accommodate the nutations induced by the mud motor power section.

Operation of Tool During Drilling

Referring primarily to FIGS. 1, 8, and 9, during rotary drilling, operations, spline sub 20 is axially positioned with respect to complete housing assembly 19 such that upper spline 25 is positioned adjacent to and meshes with collapsible splines 71 of knuckle housing 70. During this time, collapsible splines 71 remain in their normal radial inward positions as urged by springs 76B. As spline sub 20 is rotated by the drill pipe via connector 21, splines 25, 71 transfer the drill string torque to the knuckle housing 70. Projecting key 64 and keyway slot 72 transfer the rotational torque of knuckle housing 70 to knuckle lock ring 60, which in turn transfers the rotational torque to the remainder of the complete housing assembly 19, including connector 94 of lower housing 90.

Figure 12:
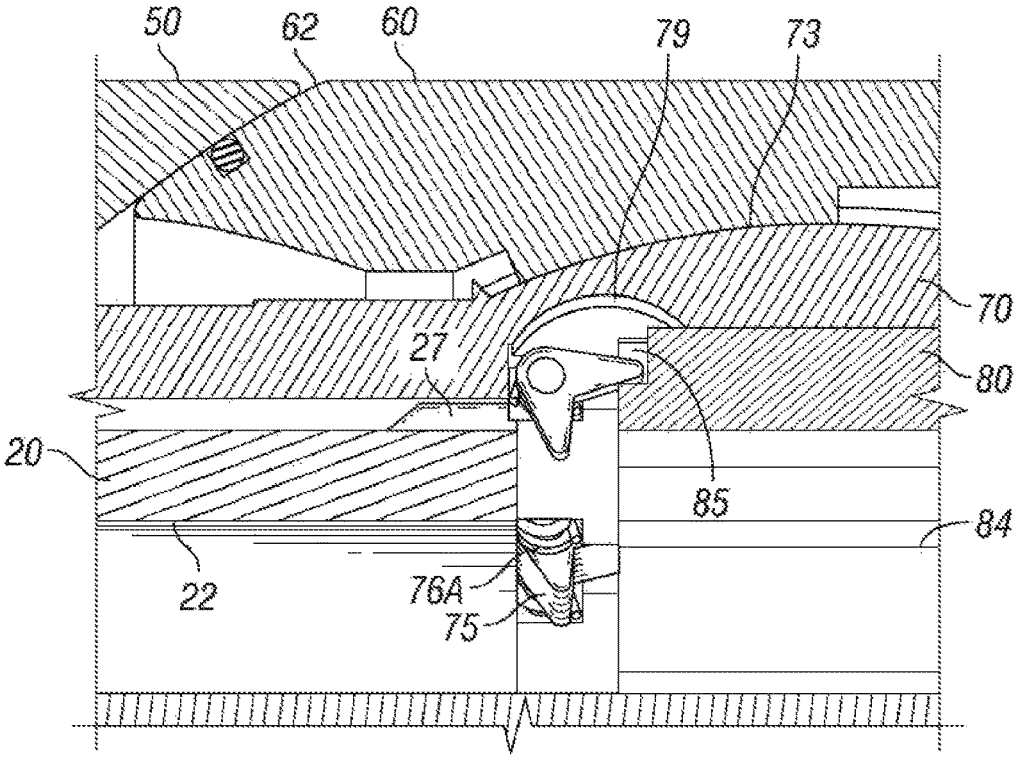
FIG. 12 is a detailed axial cross section of the setting ring of FIG. 10B received in the mouth of the knuckle housing of FIG. 9, which is in turn received in the knuckle lock ring of FIG. 9, showing toggles having fingers received into slots in the upper face of the setting ring for preventing relative rotation between the setting ring, and the knuckle housing, thereby maintaining a set bend angle.

During this time, toggles 75 are oriented by springs 76A so that they are pivoted radially inward (see FIG. 12). Accordingly, the outer fingers of toggles 75 are received into slots 85 in setting ring 80, thereby causing setting ring 80 to rotate with knuckle housing 70. Because toggles 85 prevent any relative motion between the setting ring 80 and the lower housing 90, the bend angle does not change.

Weight on bit is transferred from the drill string to spline sub 20 via pin connector 21. Belleville springs 36 urge lower retaining ring 34 upwards, compressing latches 35 between the tapered surfaces of upper and lower retaining rings 33, 34 and forcing latches 35 radially inward into intimate contact with latch grooves 24 of spline sub 20. The belleville springs 36 are selected and designed so that latches 35 remain engaged with latch grooves 24 so long as maximum operation weight on bit set points are not exceeded. Latch grooves 24 and latches 35 preferably have complementary tapered serrated profiles. Accordingly, downward axial weight in bit is transferred from spline shaft 20 through latch grooves 24 to latches 35, and through lower retaining ring 34, belleville springs 36, and spacer ring 37 to knuckle extension 50. The lower spherical surface 52 of knuckle extension 50 transfers the downward axial force to the upper spherical surface 62 of knuckle lock ring 60. Finally, knuckle lock ring 60 transfers weight on bit via threads 61, 91, lower housing 90, and lower pin connector 94.

Operation of Tool During Bend Setting

Figure 15:
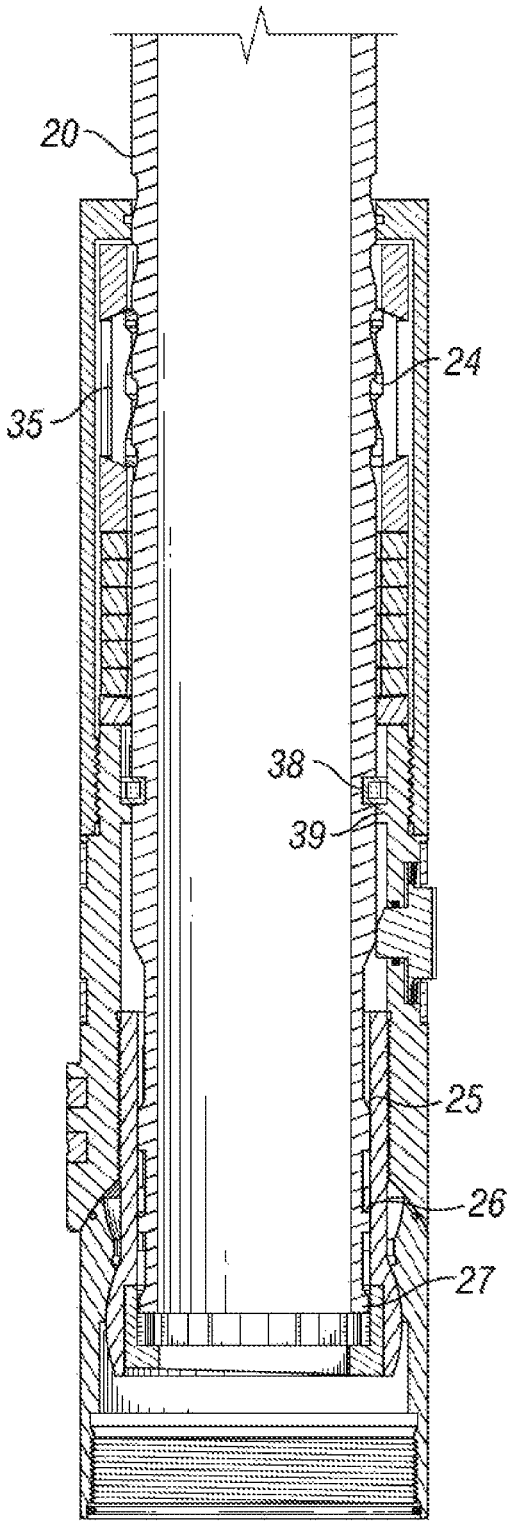
FIG. 15 is an enlarged axial cross section of the assembled spline shaft, lock housing assembly, and knuckle assembly of FIG. 9, showing the spline shaft axially displaced within the lock housing assembly to a lower bend setting position for adjusting the bend angle.

Referring to FIGS. 1 and 15, when drilling has advanced to a "kick-off" point, it may be desired to adjust the bend angle of tool 10. Drill string rotation and drilling fluid circulation are stopped. Weight on bit is applied, which causes the serrated beveled latch grooves 24 of spline sub 20 to apply radially outward force against latches 35, which in turn, due to the lower beveled surface of the latches 35, applies an axial downward force on lower retaining ring 34 and belleville springs 36. When weight on bit exceeds the maximum operational set point, belleville springs 36 are sufficiently compressed so as to allow latches 35 to move radially outward far enough to disengage from latch grooves 24. At this time, spline sub 20 moves axially downward within the complete housing assembly 19 until stopper ring 38 seats against an internal shoulder 39 formed in knuckle extension 50.

Figure 13:
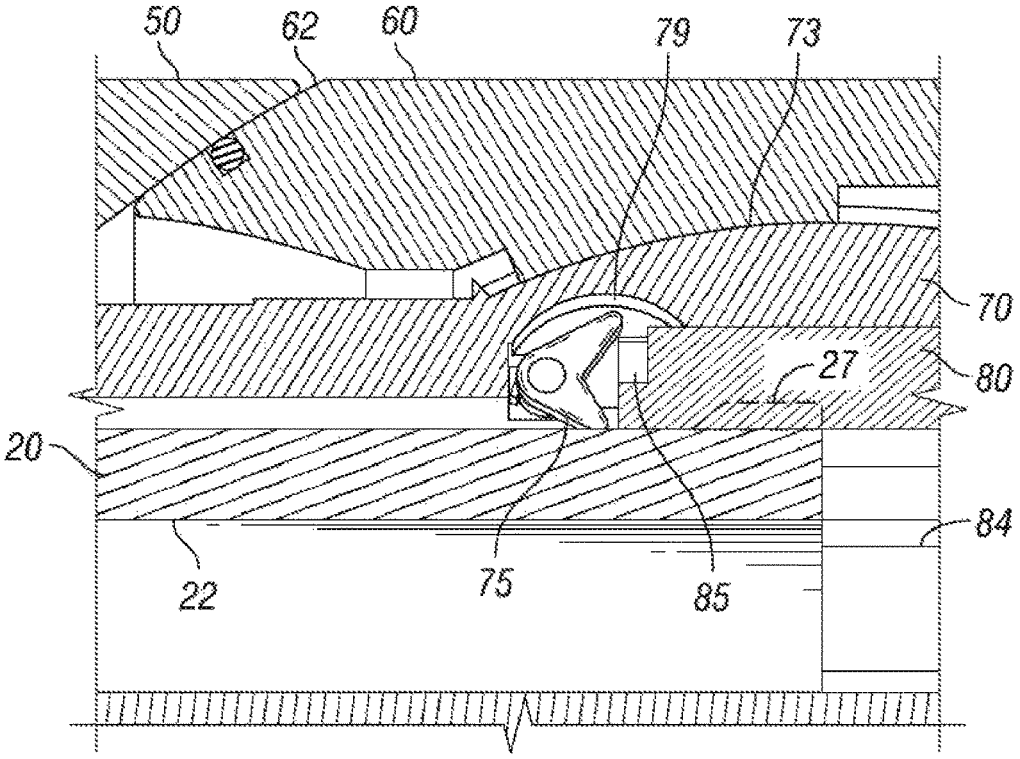
FIG. 13 is the detailed axial cross section of FIG. 12, showing the toggles in a flipped state due to displacement by the spline shaft of FIG. 2 thereby allowing relative rotation between the setting ring and the knuckle housing for adjusting bend angle.

As shown in FIG. 12, in the default, radially inward position, the outer fingers of toggles 75 extend axially downward into an engaged position so as to engage slots 85 in setting ring 80, thereby holding setting ring 80 rotationally stationary with respect to knuckle housing 70. As shown in FIG. 13, during bend setting adjustment, as spline sub 20 moves axially downward, its lower end 22 first contacts the inner fingers of toggles 75, flipping the toggles to the radially outward position. In the radially outward position, the outer fingers of toggles 75 are pivoted to a disengaged position so as to be clear of slots 85 in setting ring 80, thereby allowing rotation of setting ring 80 with respect to knuckle housing 70. As spline sub 20 continues its axial downward movement, lower external spline 27 of spline shaft 20 engages internal spline 84 of setting ring 80.

As illustrated by FIGS. 1, 9 and 15, shoes 40 move radially outward due to the downward sliding of spline sub 20, in which tapered shoulder 28 contacts tapered surfaces 42 of shoes 40 as described above. Shoes 40 engage the borehole wall to hold tool 10 stationary with respect to the formation to establish a reference point and to allow the drill string to rotate spline sub 20 and setting ring 80 with respect to the complete housing assembly 19 during bend setting operations.

Lower spline 27 of spline sub 20 engages and meshes with internal spline 84 of setting ring 80 during bend setting. From the zero degree bend configuration of FIG. 1, when spline sub 20 is rotated by 180 degrees, the lower tapered face 81 of setting ring 80 causes the lower housing to tilt to its extreme tilted position, as shown in FIG. 14. The tilting relationship is linearly related to the slope of lower face 81 of setting ring 80. That is, if lower face 81 has a three degree inclination, then the lower housing 90 will also tilt by three degrees. The minimum amount that tilting can be adjusted, i.e., the maximum tilting resolution or the least achievable tilt adjustment, is determined by the number and circumferential spacing of toggles 75.

Once the desired bend is set, weight on bit is reduced and spline sub 20 is raised with respect to complete housing assembly 19. Once the lower end 22 of spline sub 20 clears toggles 75, toggle springs 76A force toggles 75 to the radially inward position to reengage slots 85, thereby holding setting ring 80 in its new position with respect to knuckle housing 70.

A particular scenario may occur while pulling spline sub 20 from setting ring 80 after bend setting. It may happen that the outer fingers of toggles 75 are not aligned with slots 85 in setting ring 80. In this case setting ring 80 is not locked to knuckle housing 70. Accordingly, to avoid this situation, bosses 26 are provided on the outer surface of spline sub 20 (FIG. 2) and arcuate protrusions, i.e., inwardly protruding arches, 78 are provided in the internal surface of knuckle housing 70 (FIG. 8). As spline sub 20 is raised, bosses 26 engage arches 78 and force spline sub 20 to rotate to fully disengage from setting ring 80. This action rotatively aligns toggles 75 with slots 85 in setting ring 80.

FIG. 16 illustrates a drilling system 120 according to an embodiment that employs bent sub tool 10. Drilling, system 120 may include land drilling rig 122. However, teachings of the present disclosure may be satisfactorily used in association with offshore platforms, semi-submersible, drill ships and any other drilling system satisfactory for forming a wellbore extending through one or more downhole formations.

Drilling rig 122 may be located proximate well head 124. Drilling rig 122 also includes rotary table 138, rotary drive motor 140 and other equipment associated with rotation of drill string 132 within well bore 160. Annulus 166 may be formed between the exterior of drill string 132 and the inside diameter of wellbore 160.

Drilling rig 122 may also include top drive motor or top drive unit 142. Blow out preventers (not expressly shown) and other equipment associated with drilling a wellbore may also be provided at well head 124. One or more pumps 148 may be used to pump drilling fluid 146 from fluid reservoir or pit 130 to one end of drill string 132 extending from well head 124. Conduit 134 may be used to supply drilling mud from pump 148 to the one end of drilling string 132 extending from well head 124. Conduit 136 may be used to return drilling fluid, formation cuttings and/or downhole debris from the bottom or end 162 of wellbore 160 to fluid reservoir or pit 130. Various types of pipes, tube and/or conduits may be used to form conduits 134 and 136.

Drill string 132 may extend from well head 124 and may be coupled with a supply of drilling fluid such as pit or reservoir 130. The opposite end of drill string 132 may include bottom hole assembly 189 and rotary drill bit 192 disposed adjacent to end 162 of wellbore 160. Rotary drill bit 192 may include one or more fluid flow passageways with respective nozzles (not expressly illustrated) disposed therein. Various types of drilling fluids 146 may be pumped from reservoir 130 through pump 148 and conduit 134 to the end of drill string 132 extending from well head 124. The drilling fluid 146 may flow through a longitudinal bore (not expressly shown) of drill string 132 and exit from the nozzles 16 formed in rotary drill bit 192.

At end 162 of wellbore 160, drilling fluid 146 may mix with formation cuttings and other downhole debris proximate drill bit 192. The drilling fluid will then flow upwardly through annulus 166 to return formation cuttings and other downhole debris to well head 124. Conduit 136 may return the drilling fluid to reservoir 130. Various types of screens, filters and/or centrifuges (not shown) may be provided to remove formation cuttings and other downhole debris prior to returning drilling fluid to pit 130.

Bottom hole assembly 189 includes mud motor power section 190, bent sub assembly 10, and mud motor bearing section 194. Bottom hole assembly 189 may also include various other tools (not illustrated) that provide logging or measurement data and other information from the bottom of wellbore 160.

In summary, a downhole tool, drilling system, and a method for adjusting the bend angle of a downhole tool have been described. Embodiments of the downhole tool may generally have an upper housing assembly, a setting ring having a tapered bearing surface disposed within the upper housing assembly, a spline sub arranged for connection to a drill string, the spline sub being axially movable with respect to the upper housing assembly and the setting ring between a normal position in which torque is transferred between the spline sub and the upper housing assembly and a bend setting position in which torque is transferred between the spline sub and the setting ring so as to allow rotation of the setting ring with respect to the upper housing assembly, and a lower housing assembly pivotally coupled to the upper housing assembly and bearing against the bearing surface of the setting ring, whereby the rotational position of the setting ring with respect to the upper housing, assembly determines the pivot angle of the lower housing assembly with respect to the upper housing assembly. Embodiments of the drilling system may generally have a drill string, a spline sub coupled to the drill string and partially received within and axially movable with respect to an upper housing assembly, a setting ring having a tapered bearing surface disposed within the upper housing assembly, the spline sub being axially movable with respect to the setting ring between a normal position in which torque is transferred between the spline sub and the upper housing assembly and a bend setting, position in which torque is transferred between the spline sub and the setting ring so as to allow rotation of the setting ring with respect to the upper housing assembly, and a lower housing assembly pivotally coupled to the upper housing assembly and bearing against the bearing surface of the) setting ring, whereby the rotational position of the setting ring with respect to the upper housing assembly determines the pivot angle of the lower housing assembly with respect to the upper housing assembly. Embodiments of the method for adjusting the bend angle of a downhole tool may generally include providing an upper housing assembly, providing a setting ring having a tapered bearing surface within the upper housing assembly, providing a spline sub arranged for connection to a drill string, the spline sub being axially movable with respect to the upper housing assembly and the setting ring, providing a lower housing assembly pivotally coupled to the upper housing assembly and bearing against the bearing surface of the setting ring, lowering the spline sub from a normal position in which torque is transferred between the spline sub and the upper housing assembly to a bend setting position in which torque is transferred between the spline sub and the setting ring so as to allow rotation of the setting ring with respect to the upper housing assembly, and then rotating the setting ring by rotating the spline sub, whereby the rotational position of the setting ring with respect to the upper housing assembly determines the pivot angle of the lower housing assembly with respect to the upper housing assembly.

Any of the foregoing embodiments may include any one of the following elements or characteristics, alone or in combination with each other: A toggle coupled to the upper housing assembly so as to have an engaged position in which the toggle fixes the setting ring to the upper housing assembly and a disengaged position in which the setting ring can be rotated with respect to the upper housing assembly; the toggle is positioned so that spline sub in the bend setting position forces the toggle into the disengaged position; the spline sub includes an upper spline and a lower spline; the setting ring includes an internal spline; the upper housing assembly includes an internal spline; when the spline sub is in the normal position, the upper spline engages the internal spline of the upper housing assembly and the lower spline of the spline sub does not engage the internal spline of the setting ring; when the spline sub is in the bend setting position, the lower spline engages the internal spline of the setting ring and the upper spline does not engage the internal spline of the upper housing assembly; a pocket formed in a wall of the upper housing assembly; a shoe disposed the cavity so as to be movable in a radial direction, the shoe having an inclined face on an interior end; a tapered shoulder formed on the spline sub; the tapered shoulder is positioned so as to engage the inclined face and force the shoe radially outward when the spline sub is in the bend setting position; a spring coupled between the spline sub and the upper housing assembly urging the spline sub toward the normal position; a latch groove formed, about the spline sub; a latch disposed within the upper housing assembly and urged radially inward by the spring so as to engage the latch groove; the upper housing assembly includes an internal spherical surface and an external spherical surface; the lower housing assembly has an external spherical surface that mates with the internal spherical surface of the upper housing assembly; the lower housing assembly has an internal spherical surface that mates with the external spherical surface of the upper housing assembly; the lower housing assembly is pivotally connected to the upper housing assembly by being sandwiched between the internal spherical surface of the upper housing assembly and the external spherical surface of the upper housing assembly; the upper housing assembly includes a knuckle extension that defines the internal spherical surface of the upper housing assembly; the upper housing assembly includes a knuckle housing that is threaded to the knuckle extension; the knuckle housing defines the external spherical surface of the upper housing assembly; the lower housing assembly is pivotally captured between the knuckle extension and the knuckle housing; the knuckle housing defines a mouth; the setting ring is received into the mouth of the knuckle housing; a plurality of toggles coupled to the knuckle housing and pivotal between an engaged position that fixes the setting ring within the mouth and a disengaged position in which the setting ring can be rotated within the mouth; the setting ring includes a plurality of slots; the plurality of toggles is selectively partially received in the plurality of slots; a boss formed on an external surface of the spline sub; an arcuate protrusion formed on an internal surface of the knuckle housing; an interaction between the boss and the arcuate protrusion causes the plurality of slots to rotatively align with the plurality of toggles; a boss connected to the lower housing assembly and bearing against the bearing surface of the setting ring; a telescopically adjustable button disposed between the lower housing assembly and the bearing surface of the setting ring; a spring disposed between the button and the lower housing assembly urging the button against the bearing surface; a constant velocity shaft assembly disposed within the spline sub, the upper housing assembly, and the lower housing assembly; a mud motor power section coupled between the drill string and the upper housing assembly; a mud motor bearing section coupled to the lower housing assembly; a constant velocity shaft assembly at least partially disposed within the spline sub and coupled between the mud motor power section and the mud motor bearing section; providing a pocket formed in a wall of the upper housing assembly; disposing a shoe in the cavity so as to be movable in a radial direction, the shoe having an inclined face on an interior end; providing a tapered shoulder formed on the spline sub, the tapered shoulder being positioned so as to engage the interior face and three the shoe radially outward when the spline sub is in the bend setting position; lowering the spline sub from the normal position to the bend setting position to thereby move the shoe radially outward; providing a toggle coupled to the upper housing assembly so as to have an engaged position in which the toggle fixes the setting ring to the upper housing assembly and a disengaged position in which the setting ring can be rotated with respect to the upper housing assembly; lowering the spline sub from the normal position to the bend setting, position to thereby move the toggle to the disengaged position; and providing a spring coupled between the spline sub and the upper housing assembly urging the spline sub toward the normal position.

The Abstract of the disclosure is solely for providing, the United States Patent and Trademark Office and the public at large with a way by which to determine quickly from a cursory reading the nature and gist of technical disclosure, and it represents solely one or more embodiments.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

What is claimed is:

1. A tool for downhole use comprising:

an upper housing assembly;

a setting ring having an angled bearing surface such that the setting ring defines a point of maximum axial length and a point of minimum axial length about a circumference of the setting ring, the setting ring disposed within the upper housing assembly;

a spline sub arranged for connection to a drill string, the spline sub being axially movable with respect to the upper housing assembly and the setting ring between a normal position in which torque is transferred between the spline sub and the upper housing assembly and a bend setting position in which torque is transferred between the spline sub and the setting ring so as to allow rotation of the setting ring with respect to the upper housing assembly; and a lower housing assembly pivotally coupled to the upper housing assembly and having an upper end, said upper end including at least one fixed boss extending a fixed axial distance from one lateral side of said lower housing assembly, an axial end of said fixed boss bearing against the angled bearing surface of the setting ring as said setting ring rotates with respect to said upper housing assembly; whereby rotating the setting ring to a rotational position with respect to the upper housing assembly to align the point of maximum axial length with said fixed boss extending from said one lateral side of the housing assembly orients the lower housing assembly at a pivot angle with respect to the upper housing assembly that is greater than the pivot angle at which the lower housing assembly is oriented when the setting ring is rotated to align the point of minimum axial length with the lateral side of the lower housing assembly.

2. The tool of claim 1 further comprising:

a toggle coupled to the upper housing assembly so as to have an engaged position in which the toggle fixes the setting ring to the upper housing assembly and a disengaged position in which the setting ring can be rotated with respect to the upper housing assembly; wherein said toggle is positioned so that spline sub in the bend setting position forces the toggle into the disengaged position.

3. The tool of claim 1 wherein:

said spline sub includes an upper spline and a lower spline;

said setting ring includes an internal spline;

said upper housing assembly includes an internal spline;

when the spline sub is in the normal position, the upper spline engages the internal spline of the upper housing assembly and the lower spline of the spline sub does not engage the internal spline of the setting ring; and when the spline sub is in the bend setting position, the lower spline engages the internal spline of the setting ring and the upper spline does not engage the internal spline of the upper housing assembly.

4. The tool of claim 1 further comprising:

a pocket formed in a wall of the upper housing assembly;

a shoe disposed the pocket so as to be movable in a radial direction, the shoe having an inclined face on an interior end; and a tapered shoulder formed on the spline sub; wherein said tapered shoulder is positioned so as to engage the inclined face and force the shoe radially outward when the spline sub is in the bend setting position.

5. The tool of claim 1 further comprising:

a spring coupled between the spline sub and the upper housing assembly urging the spline sub toward the normal position.

6. The tool of claim 5 further comprising:

a latch groove formed about the spline sub;

a latch disposed within the upper housing assembly and urged radially inward by the spring so as to engage the latch groove.

7. The tool of claim 1 wherein:

said upper housing assembly includes an internal spherical surface and an external spherical surface;

said lower housing assembly has an external spherical surface that mates with the internal spherical surface of the upper housing assembly;

said lower housing assembly has an internal spherical surface that mates with the external spherical surface of the upper housing assembly; and said lower housing assembly is pivotally connected to the upper housing assembly by being sandwiched between the internal spherical surface of the upper housing assembly and the external spherical surface of the upper housing assembly.

8. The tool of claim 7 wherein:

said upper housing assembly includes a knuckle extension that defines the internal spherical surface of the upper housing assembly;

said upper housing assembly includes a knuckle housing that is threaded to the knuckle extension;

said knuckle housing defines the external spherical surface of the upper housing assembly; and said lower housing assembly is pivotally captured between the knuckle extension and the knuckle housing.

9. The tool of claim 1 wherein:

said knuckle housing defines a mouth; and said setting ring is received into the mouth of the knuckle housing.

10. The tool of claim 9 further comprising:

a plurality of toggles coupled to the knuckle housing and pivotal between an engaged position that fixes the setting ring within the mouth and a disengaged position in which the setting ring can be rotated within the mouth.

11. The tool of claim 10 wherein:

said setting ring includes a plurality of slots; and said plurality of toggles is selectively partially received in the plurality of slots.

12. The tool of claim 11 further comprising:

a boss formed on an external surface of the spline sub; and an arcuate protrusion formed on an internal surface of the knuckle housing; wherein an interaction between the boss and the arcuate protrusion causes the plurality of slots to rotatively align with the plurality of toggles.

13. The tool of claim 1 wherein:

said fixed boss connected to the lower housing assembly includes a rounded axial end bearing against the bearing surface of the setting ring.

14. The tool of claim 1 further comprising:

a telescopically adjustable button extending from an opposite lateral side of said upper end of said lower housing assembly than said fixed boss disposed between the lower housing assembly and the bearing surface of the setting ring; and a spring disposed between the button and the lower housing assembly urging the button against the bearing surface.

15. The tool of claim 1 further comprising:

a constant velocity shaft assembly disposed within the spline sub, the upper housing assembly, and the lower housing assembly.

16. A method for adjusting the bend angle of a tool for downhole use, comprising:

providing an upper housing assembly to a downhole location;

providing a setting ring within the upper housing assembly, the setting ring having an angled bearing surface such that the setting ring defines a point of maximum axial length and a point of minimum axial length about a circumference of the setting ring, the setting ring;

providing a spline sub to the downhole location, the spline sub arranged for connection to a drill string, and being axially movable with respect to the upper housing assembly and the setting ring;

providing a lower housing assembly to the downhole location, the lower housing assembly pivotally coupled to the upper housing assembly, an upper end of said lower housing assembly including at least one fixed boss extending a fixed axial distance from one lateral side of said upper housing, an axial end of said fixed boss bearing against the bearing surface of the setting ring as said setting ring rotates with respect to said upper housing assembly;

lowering the spline sub from a normal position in which torque is transferred between the spline sub and the upper housing assembly to a bend setting position in which torque is transferred between the spline sub and the setting ring so as to allow rotation of the setting ring with respect to the upper housing assembly; and then rotating the spline sub at the downhole location to thereby rotate setting ring with respect to the upper housing assembly, wherein the setting ring is rotated either toward a rotational position wherein the point of maximum length is aligned with said fixed boss extending from said one lateral side of the housing assembly to thereby increase a pivot angle of the lower housing assembly with respect to the upper housing assembly, or toward a rotational position wherein the point of minimum axial length is aligned with the lateral side of the housing assembly to thereby decrease the pivot angle of the lower housing assembly with respect to the upper housing assembly.

17. The method of claim 16 further comprising:

providing a pocket formed in a wall of the upper housing assembly;

disposing a shoe in the pocket so as to be movable in a radial direction, the shoe having an inclined face on an interior end; and providing a tapered shoulder formed on the spline sub, the tapered shoulder being positioned so as to engage the inclined face and force the shoe radially outward when the spline sub is in the bend setting position; and lowering the spline sub from the normal position to the bend setting position to thereby move the shoe radially outward.

18. The method of claim 16 further comprising:

providing a toggle coupled to the upper housing assembly so as to have an engaged position in which the toggle fixes the setting ring to the upper housing assembly and a disengaged position in which the setting ring can be rotated with respect to the upper housing assembly; and lowering the spline sub from the normal position to the bend setting position to thereby move the toggle to the disengaged position.

19. The method of claim 16 further comprising:

providing a spring coupled between the spline sub and the upper housing assembly that urges the spline sub toward the normal position.

20. A drilling system comprising:

a drill string;

a spline sub coupled to the drill string and partially received within and axially movable with respect to an upper housing assembly;

a setting ring having an angled bearing surface such that the setting ring defines a point of maximum axial length and a point of minimum axial length about a circumference of the setting ring, the setting ring disposed within the upper housing assembly;

said spline sub being axially movable with respect to the setting ring between a normal position in which torque is transferred between the spline sub and the upper housing assembly and a bend setting position in which torque is transferred between the spline sub and the setting ring so as to allow rotation of the setting ring with respect to the upper housing assembly; and a lower housing assembly pivotally coupled to the upper housing assembly and having an upper end, said upper end including at least one fixed boss extending a fixed axial distance from one lateral side of said lower housing assembly, an axial end of said fixed boss bearing against the angled bearing surface of the setting ring such that an axial separation is maintained between said upper end of said lower housing assembly and said bearing surface of said setting ring as said setting ring rotates with respect to said the upper housing assembly; whereby rotating the setting ring to a rotational position with respect to the upper housing assembly to align the point of maximum axial length with said fixed boss extending from said one lateral side of the lower housing assembly orients the lower housing assembly at a pivot angle with respect to the upper housing assembly that is greater than the pivot angle at which the lower housing assembly is oriented when the setting ring is rotated to align the point of minimum axial length with the lateral side of the lower housing assembly.

21. The drilling system of claim 20 further comprising:

a mud motor power section coupled between the drill string and the upper housing assembly;

a mud motor bearing section coupled to the lower housing assembly; and a constant velocity shaft assembly at least partially disposed within the spline sub and coupled between the mud motor power section and the mud motor bearing section.

22. The drilling system of claim 20 further comprising:

a toggle coupled to the upper housing assembly so as to have an engaged position in which the toggle fixes the setting ring to the upper housing assembly and a disengaged position in which the setting ring can be rotated with respect to the upper housing assembly; wherein said toggle is positioned so that spline sub in the bend setting position forces the toggle into the disengaged position.

23. The drilling system of claim 20 wherein:

said upper housing assembly includes an internal spherical surface and an external spherical surface;

said lower housing assembly has an external spherical surface that mates with the internal spherical surface of the upper housing assembly;

said lower housing assembly has an internal spherical surface that mates with the external spherical surface of the upper housing assembly; and said lower housing assembly is pivotally connected to the upper housing assembly by being sandwiched between the internal spherical surface of the upper housing assembly and the external spherical surface of the upper housing assembly.

* * * * *